US008169292B2

(12) United States Patent
Gardner et al.

(10) Patent No.: US 8,169,292 B2
(45) Date of Patent: May 1, 2012

(54) HIGH VOLTAGE FUSE WITH UNIVERSAL FUSE TERMINAL

(75) Inventors: Dan Gardner, Hickory, NC (US); Gene Wood, Hickory, NC (US)

(73) Assignee: Thomas & Betts International, Inc., Wilmington, DE (US)

( * ) Notice: Subject to any disclaimer, the term of this patent is extended or adjusted under 35 U.S.C. 154(b) by 294 days.

(21) Appl. No.: 12/335,973

(22) Filed: Dec. 16, 2008

(65) Prior Publication Data

US 2009/0160597 A1 Jun. 25, 2009

Related U.S. Application Data

(60) Provisional application No. 60/015,772, filed on Dec. 21, 2007.

(51) Int. Cl.

| | |
|---|---|
| ***H01H 85/46*** | (2006.01) |
| ***H01H 85/04*** | (2006.01) |
| ***H01H 69/02*** | (2006.01) |
| ***H01R 11/01*** | (2006.01) |

(52) U.S. Cl. ..... 337/187; 337/158; 337/228; 29/623; 439/756; 439/798

(58) Field of Classification Search ..... 337/142, 337/187, 228, 158; 439/756, 798; 29/623
See application file for complete search history.

(56) References Cited

U.S. PATENT DOCUMENTS

| | | | | | |
|---|---|---|---|---|---|
| 2,039,669 | A | * | 5/1936 | Tenney | 439/175 |
| 2,448,402 | A | * | 8/1948 | Thompson | 439/803 |
| 2,841,774 | A | * | 7/1958 | Romanek | 439/771 |
| 2,907,978 | A | * | 10/1959 | Bergan | 439/811 |
| 3,181,111 | A | * | 4/1965 | Moloney | 439/798 |
| 3,638,172 | A | * | 1/1972 | Adam | 439/791 |
| 3,760,341 | A | * | 9/1973 | Grad | 439/804 |
| 3,893,744 | A | * | 7/1975 | Porazinski | 439/763 |
| 3,923,363 | A | * | 12/1975 | Kraft | 439/413 |
| 4,059,816 | A | * | 11/1977 | Bonecutter et al. | 337/278 |
| 4,070,086 | A | * | 1/1978 | Trafford | 439/717 |
| 4,128,291 | A | * | 12/1978 | Peterson, Jr. | 439/786 |
| 4,784,621 | A | * | 11/1988 | Auclair | 439/793 |
| 4,830,631 | A | * | 5/1989 | Hsueh | 439/620.33 |
| 4,863,390 | A | * | 9/1989 | Cera et al. | 439/100 |
| 4,917,615 | A | * | 4/1990 | Franks, Jr. | 439/98 |
| 5,049,092 | A | * | 9/1991 | Takano et al. | 439/540.1 |
| 5,085,583 | A | * | 2/1992 | Amos et al. | 439/479 |
| 5,201,678 | A | * | 4/1993 | Venezia | 439/723 |
| 5,300,912 | A | * | 4/1994 | Tillery et al. | 337/180 |
| 5,328,392 | A | * | 7/1994 | Lin et al. | 439/833 |
| 5,597,331 | A | * | 1/1997 | Gable et al. | 439/754 |

(Continued)

*Primary Examiner* — Bradley Thomas
(74) *Attorney, Agent, or Firm* — Hoffman & Baron LLP

(57) ABSTRACT

A high voltage fuse which includes at least one fuse terminal located at a distal end of the fuse housing. One face of the fuse terminal includes an elongated groove and an opposite face includes at least two elongated grooves. An aperture extends through the fuse terminal from the first face to the second face. The first face is adapted for use with an eyebolt connector component to attach a single conductor to be in direct contact with the fuse terminal. The second face is adapted for use with a parallel groove connector clamping component to attach a pair of conductors in direct contact with the fuse terminal. Alternatively, the grooves on the first and second faces may be provided on a single face of the fuse terminal. The fuse terminal may also serve the function of a spade connector. Thus, the fuse terminal provides improved versatility to allow a variety of connectors to be used therewith.

12 Claims, 9 Drawing Sheets

U.S. PATENT DOCUMENTS 5,618,209 A * 4/1997 Lin et al. ..... 439/620.26
5,664,971 A * 9/1997 Coy ..... 439/811
5,772,473 A * 6/1998 Cheng et al. ..... 439/620.34
5,888,098 A * 3/1999 Cheng et al. ..... 439/620.28
6,004,159 A * 12/1999 Liang ..... 439/620.27
6,053,779 A * 4/2000 Liang ..... 439/756
6,162,097 A * 12/2000 Liang ..... 439/620.27
6,162,098 A * 12/2000 Cheng et al. ..... 439/620.29
6,165,020 A * 12/2000 Cheng et al. ..... 439/620.31
6,234,850 B1 * 5/2001 Pandit et al. ..... 439/801
6,347,958 B1 * 2/2002 Tsai ..... 439/488
6,512,443 B1 * 1/2003 Matsumura et al. ..... 337/189
6,544,073 B2 * 4/2003 Kieninger et al. ..... 439/620.28
6,551,141 B2 * 4/2003 Liang ..... 439/620.27
6,817,907 B2 * 11/2004 Cheng et al. ..... 439/754
6,902,434 B2 * 6/2005 Stack ..... 439/620.28
7,115,001 B1 * 10/2006 Brockman et al. ..... 439/828
7,172,462 B1 * 2/2007 Gronowicz, Jr. ..... 439/620.26
7,452,240 B2 * 11/2008 Carter ..... 439/620.27
7,798,869 B1 * 9/2010 Konopacki et al. ..... 439/812

* cited by examiner

HIGH VOLTAGE FUSE WITH UNIVERSAL FUSE TERMINAL

CROSS-REFERENCE TO RELATED APPLICATION

This application claims priority to U.S. Provisional Patent Application Ser. No. 61/015,772 filed on Dec. 21, 2007, the disclosure of which is incorporated herein by reference.

FIELD OF THE INVENTION

The invention relates to a high voltage fuse, and more particularly to a high voltage fuse having an endcap with a fuse terminal which can accommodate many different types of connectors using fewer component parts.

BACKGROUND OF THE INVENTION

Utilities distribute power at high voltages, usually in excess of 1,000 volts, typically up to 35 kV. Line faults at these high energy levels can cause extensive damage to circuit components and devices connected to the circuit, or the conductors and various other portions of the electrical distribution system. To minimize potential damage, fuses are employed with the intent to interrupt current flow quickly following the onset of fault conditions involving high current loadings such as a short circuit or overload faults.

One such type of fuse is a back-up current limiting fuse which is applied in series with a low current protective device. The low current protective device typically is an expulsion fuse, such as a cutout fuse link, transformer internal weak link, etc. Thus, the expulsion fuse and current limiting fuse are designed to provide fault protection over a certain range of currents. The expulsion fuse is chosen to clear the low magnitude currents such as those produced by overloads and high impedance faults which are below the minimum current rating of the current limiting fuse. The back-up type current limiting fuse is selected to clear all other fault currents up to its maximum interrupting current. The current limiting fuse also provides the function of limiting the amount of energy that is let through to the source of the fault to a value below the withstand capability of the equipment being protected, thus reducing the risk of disruptive equipment failures.

Fuses can be connected into an electrical distribution system in a variety of ways. Typically, hardware in the form of complete connectors is attached to a terminal extending from the fuse endcap. The terminal itself takes various shapes such as a spade connector, a stud (either threaded or knurled) or a threaded aperture to receive, for example, an eyebolt connector. The connectors are generally added in their entirety by either bolting them on, screwing them in, or soldering to the fuse terminal. In some cases, manufacturers provide fuses with endcaps specially made to accept a particular type of connector. For example, the fuse could be made to have a spade connector on one end and a stud on the other. Thus, multiple types of connectors and/or endcaps with different fuse terminals were needed in order to provide different hardware options depending upon the application. This makes it difficult for utilities to order fuses and for utility workers who would need to bring several different fuses and hardware to a jobsite depending upon the arrangement of the distribution equipment. Furthermore, in the situation where connectors are attached to the fuse terminal by bolting or the like, extra electrical joints are created which could deteriorate over time and affect the operation of the fuse. Accordingly, it would be beneficial to design a fuse terminal which can accept the different hardware connectors and reduce the number of electrical joints in the circuit.

SUMMARY OF THE INVENTION

The present invention is a high voltage fuse including at least one terminal located at a distant end of the fuse housing. The fuse terminal includes a first face having an elongated groove therein. The groove is preferably along either a horizontal or vertical axis of the terminal. The fuse terminal also includes a second face having at least two elongated grooves therein. Likewise, these grooves can be formed along a horizontal or longitudinal axis of the second face. The fuse terminal further includes an aperture extending therethrough from the first face to the second face.

The first face is adapted to receive an eyebolt connector component and means for securing the eyebolt connector component to the fuse terminal. The securing means typically takes the form of a lock washer and nut. The eyebolt connector component includes a first end having an opening therein and a second threaded end dimensioned to receive the lock washer and nut. A cable is inserted into the aperture of the eyebolt connector component and the securing means is used to securely mount the conductor within the connector and in direct contact with the fuse terminal. Thus, only a single electrical joint exists at the point where the conductor contacts the fuse terminal. The groove in the fuse terminal cooperates with the eyebolt connector component to hold the conductor firmly in contact with the fuse terminal. The term groove as used herein is not limited to any particular shape. For example, the groove may be semi-circular in cross-section, v-shaped or be modifications thereof. A groove as used herein refers to any contour of the fuse terminal which cooperates with a conductor and connector component.

Alternatively, the high voltage fuse formed in accordance with the present invention can be used in combination with a parallel groove connector component to attach a pair of conductors of like or unlike sizes to the fuse terminal. The parallel groove connector component also includes at least two grooves which cooperate with the at least two grooves formed in the second face of the fuse terminal. A securing means in the form of a bolt, lock washer and nut are provided to secure the parallel groove connector component to the fuse terminal. Preferably, the grooves in the second face of the fuse terminal are parallel and spaced apart from each other. With a parallel groove connector component loosely attached to the fuse terminal, a pair of conductors may be inserted into the conductor receiving spaces formed between the grooves in the parallel groove connector component and the cooperating grooves in the fuse terminal second face. The conductors are secured to the terminal by the bolt and nut arrangement. The conductors are placed in direct contact with the fuse terminal which forms the only electrical joint between the conductor and the fuse terminal.

A high voltage fuse including at least one fuse terminal formed in accordance with the present invention is also adapted for use with other types of connector components and accessories. These connector components and accessories may be attached directly to the fuse terminal using the aperture located therein. The fuse terminal of the present invention provides versatility in the methods of attaching components to the fuse and reduces the amount of electrical joints to provide good electrical continuity between the conductors and the fuse component.

In a preferred embodiment, the fuse terminal includes both the first face and the second face, the first face being adapted for use in attaching a single conductor by an eyebolt connector and the second face being adapted to connect a pair of conductors through the use of a parallel groove connector cap. Alternatively, the fuse terminal may include only one of the two faces described above. In a still further embodiment, the fuse terminal formed in accordance with the present invention may include a single face adapted to receive either an eyebolt connector component or a parallel groove connector component. The fuse terminal formed in accordance with the present invention also reduces the number of connector components. Accordingly, a fuse formed in accordance with the present invention provides greater flexibility for the user during installation with less component parts to be brought to the jobsite. It also allows a utility to order only one type of fuse instead of having to order many types to get the different connectors they might require for field installations.

DETAILED DESCRIPTION OF THE PREFERRED EMBODIMENTS

Manufacturers of high voltage fuses offer a variety of terminals attached to the fuse endcaps depending on the application. For example, typical terminals include an integral eyebolt, a stud, a parallel groove, or a spade. With respect to a spade terminal, connector components, such as a loose eyebolt, parallel groove connector or universal adaptor may be bolted to the terminal using the opening provided.

Figure 1:
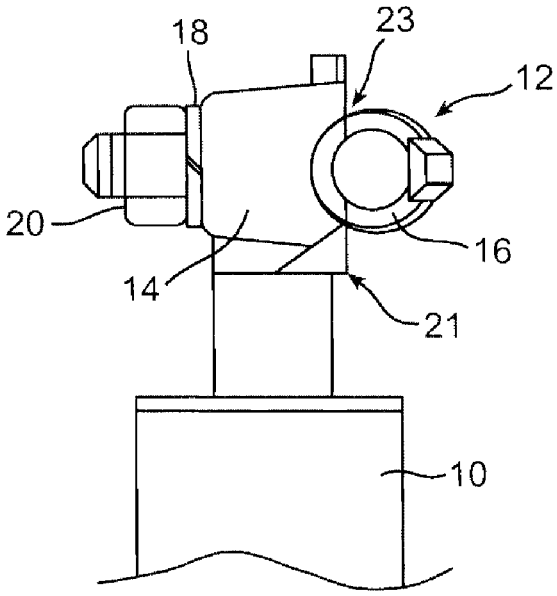
FIG. 1 PRIOR ART
FIG. 1 illustrates prior art fuse having an integral eyebolt connector.

FIG. 1 illustrates a prior art fuse 10 having an integral eyebolt connector 12 suitable for attaching one conductor to an end of the fuse. The fuse endcap includes a threaded aperture adapted to receive a threaded portion of the integral eyebolt connector 12. Typically, the eyebolt connector is made up of two cast components, a base component 14 and a threaded component having an aperture 16. The connector 12 also includes a lock washer 18 and nut 20 to secure the wire within the eyebolt aperture. Alternatively, in a fuse having a spade terminal, a loose eyebolt may be provided to extend through the aperture in the spade terminal. In either case, the eyebolt connector has two electrical joints; one joint 21 where the base component attaches to the fuse endcap and a second electrical joint 23 where the conductor attaches to the eyebolt connector.

Figure 2:
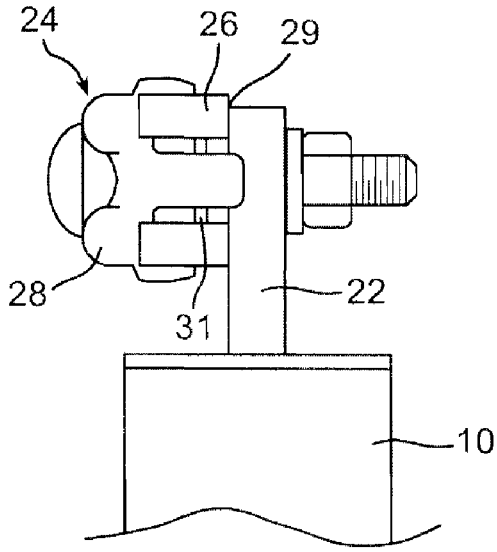
FIG. 2 PRIOR ART
FIG. 2 illustrates a prior art fuse having a spade-type terminal and a parallel groove connector mounted thereon.

FIG. 2 illustrates a prior art fuse 10 having a spade-type terminal 22. A parallel groove connector 24 adapted to attach either one or two conductors to an end of the fuse is bolted into the aperture of the spade-type terminal 22. The parallel groove connector 24 typically includes a base component 26 and a clamping component 28, each with a pair of corresponding grooves adapted to receive conductors therein. The parallel groove connector also includes a lock washer and nut to secure the conductors within the connector. Similar to the eyebolt connector, two electrical joints exist; one joint 29 where the base component attaches to the spade-type terminal and a second joint 31 where the conductors attach to the connector.

The fuse endcap including a connection terminal formed in accordance with the present invention overcomes the disadvantages of prior fuse terminals. As shown in FIGS. 3A-D, the connection terminal of the present invention has a machined contour which allows a conductor or universal adaptor to be directly connected to the fuse terminal. The fuse terminal is adapted to be used with hardware components such as an eyebolt connector component or a parallel grove connector component. Thus, a single fuse having terminals formed in accordance with the present invention can be used in any type of connection scheme thereby eliminating the need for special ordering requirements by the customer. Furthermore, the conductors are directly connected to and contacting the fuse terminal to provide superior electrical continuity when compared to prior jointed hardware.

Figure 3A:
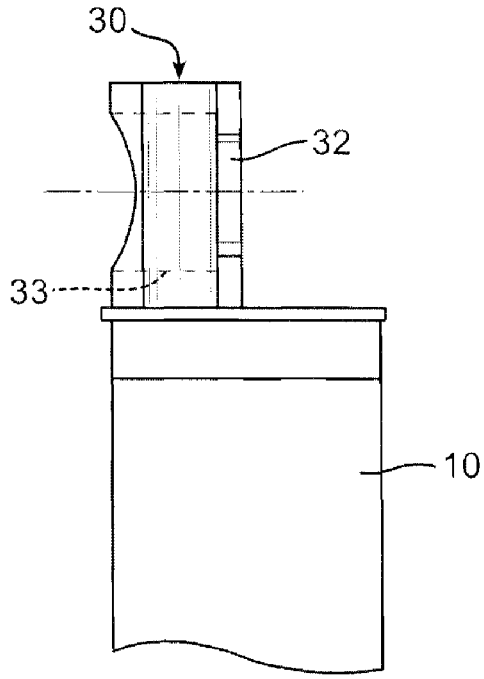
FIG. 3A is a side view of a fuse terminal formed in accordance with the present invention.

FIGS. 3A-D illustrate a fuse 10 having a fuse endcap terminal 30 formed in accordance with the present invention. FIG. 3A is a side view illustrating the fuse terminal 30 which includes a tiered aperture 32 formed therethrough to permit a bolt or other fastening device to be attached. (See also FIGS. 3B and 3C). The larger tier 33 permits a bolt head to fit fully within the opening and also extends into the periphery of the terminal to cooperate with an eyebolt connector component. One side or face of the fuse terminal includes a grooved portion 34 extending along a longitudinal axis of the terminal. The groove may also extend along a horizontal axis, if desired. The groove 34 is designed to cooperate with an eyebolt connector component to attach a single conductor to the fuse terminal 30. (See FIGS. 3C and 3D). Thus, a rear face of the fuse terminal 30 is specifically designed for a direct connection with a conductor being attached to the fuse.

Figure 3B:
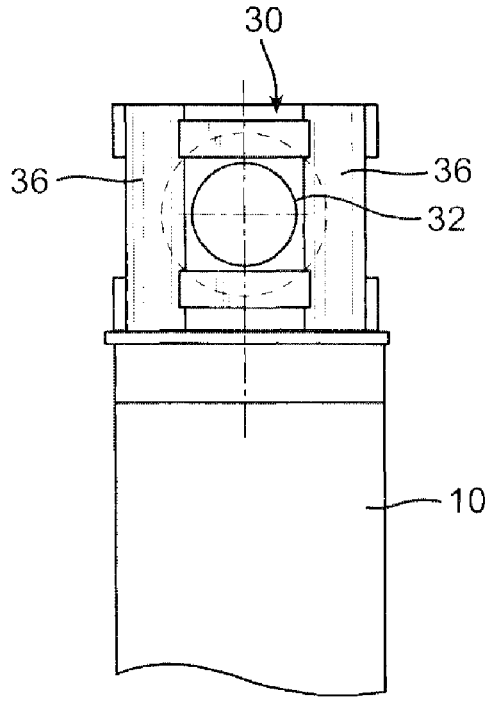
FIG. 3B is a front view of the fuse terminal shown in FIG. 3A.
Figure 3C:
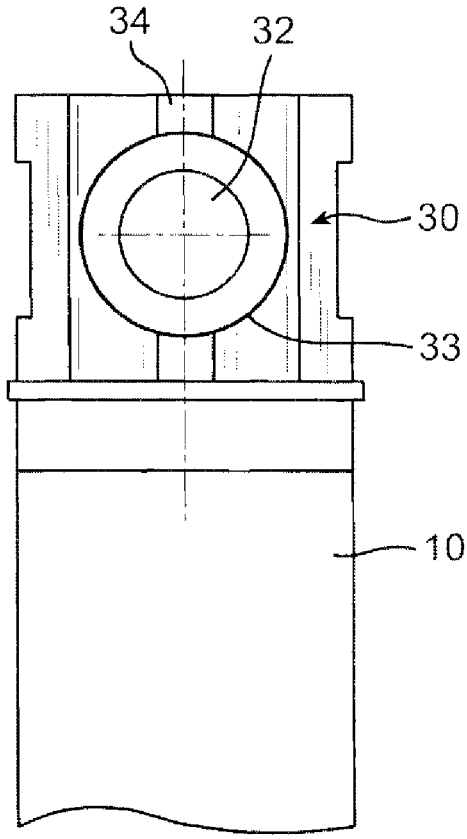
FIG. 3C is a rear view of the fuse terminal shown in FIG. 3A.
Figure 3D:
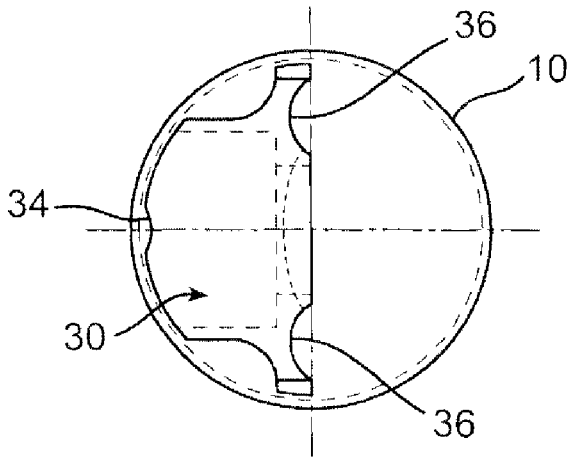
FIG. 3D is a top view of the fuse terminal shown in FIG. 3A.

Referring to FIGS. 3B and 3D, the fuse terminal 30 includes a front face having a pair of spaced apart grooves 36 extending along a longitudinal axis of the terminal. The grooves may also extend along a horizontal axis, if desired. The grooves 36 are adapted to receive a pair of conductors similar to a base component of a prior art parallel groove connector. The grooves 36 are provided on the opposite side of the terminal from the groove 32 adapted to cooperate with an eyebolt connector component. Thus, the fuse terminal 30 formed in accordance with the present invention is designed to simply add a single component in the form of an eyebolt or the clamping component of a parallel groove connector to achieve connectivity to either a single conductor or a pair of conductors to the fuse terminal. Specifically, the fuse terminal 30 includes one face which takes the place of a prior art eyebolt base component and another face which takes the place of a prior art parallel groove connector base component. Accordingly, when using the fuse fitted with the fuse terminal 30 of the present invention with either an eyebolt or parallel groove connector component, the base component part is eliminated. Thus, installers can carry less component parts yet still have the flexibility to mount conductors to the face of the fuse terminal by using either an eyebolt connector or a parallel groove connector. Along with elimination of a component part, the fuse terminal assembly of the present invention, whether used with an eyebolt or a parallel groove connector, also eliminates an electrical joint reducing the likelihood of joint deterioration.

As also shown in FIG. 3D, the fuse terminal 30 formed in accordance with the present invention is designed to fit fully within the circumference of the fuse housing. In the embodiment shown, the fuse terminal is offset whereby the front face runs along an axis dividing the fuse housing in half and the rear face includes a contour following that of the fuse housing to fit fully within the periphery of the fuse. If the fuse diameter were larger, it is envisioned that the fuse terminal could be centrally located. Moreover, while it is preferred to maintain the profile of the fuse terminal within the fuse housing periphery, a terminal which extends outside the periphery falls within the scope of the invention.

Figure 4A:
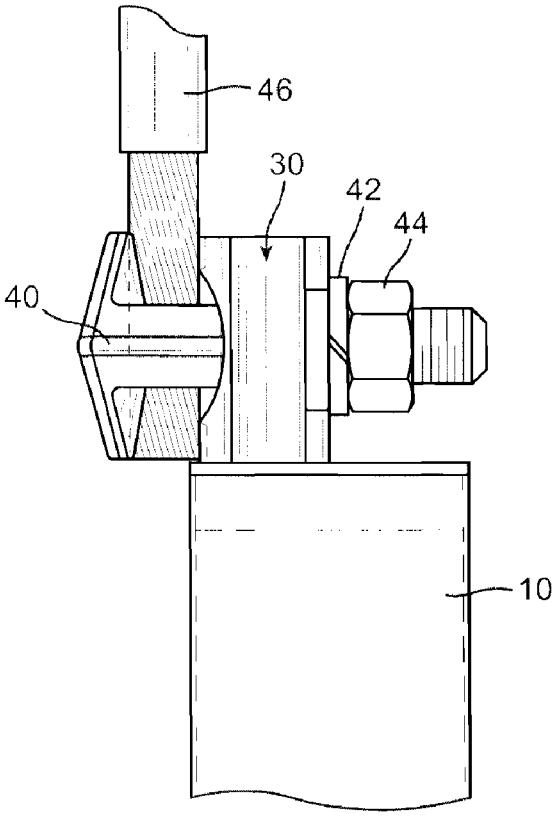
FIG. 4A illustrates a side view of a fuse terminal formed in accordance with the present invention used with an eyebolt.
Figure 4B:
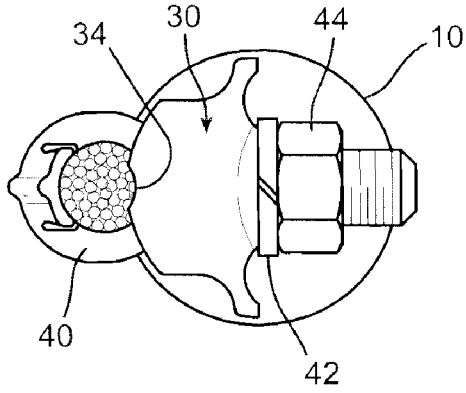
FIG. 4B is a top view of the fuse terminal shown in FIG. 4A.
Figure 4C:
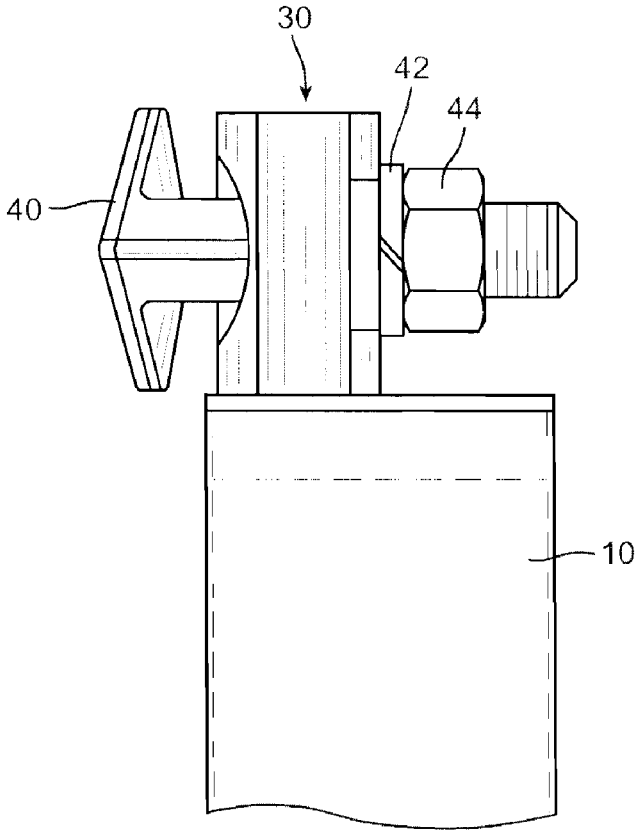
FIG. 4C is a perspective view of the fuse terminal formed in accordance with the present invention including an eyebolt connector component.

FIGS. 4A through 4C illustrate the fuse terminal formed in accordance with the present invention used as an eyebolt connector. As noted above, only a single component, an eyebolt 40 and a lock washer 42 and nut 44 are needed to attach a conductor 46 to the fuse terminal 30. The groove 34 in the fuse terminal 30 holds the conductor in place and cooperates with the eyebolt 40 to securely couple the conductor to the fuse terminal. Thus, the conductor is mounted to the fuse in direct contact with the fuse terminal 30 thereby eliminating an electrical joint when compared to prior art eyebolt connectors. Furthermore, only a single electrical joint exists at the attachment point of the conductor to the fuse terminal to provide a superior electrical connection when compared to the prior art eyebolt connectors.

Figure 5A:
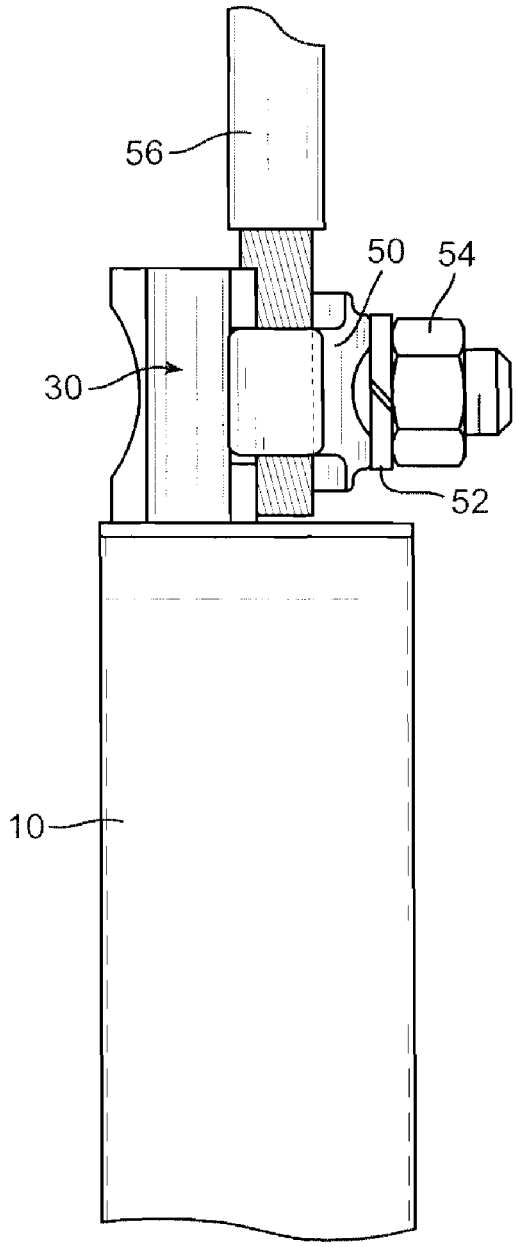
FIG. 5A illustrates a side view of the fuse terminal formed in accordance with the present invention used with a parallel groove connector component.
Figure 5B:
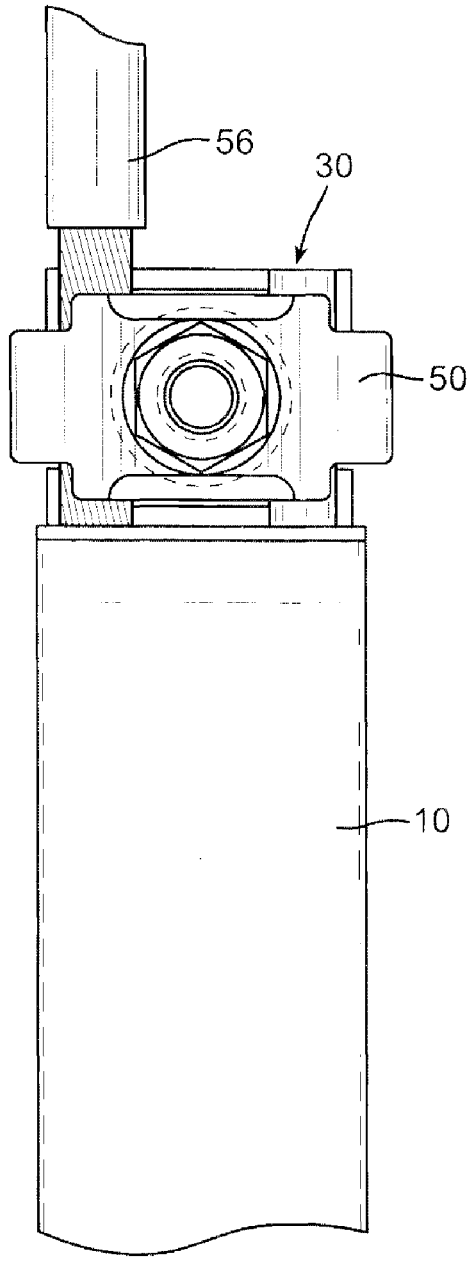
FIG. 5B is a front view of the fuse terminal shown in FIG. 5A.
Figure 5C:
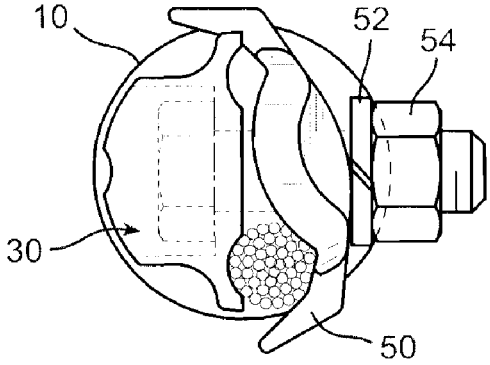
FIG. 5C is a top view of the fuse terminal shown in FIG. 5A.
Figure 5D:
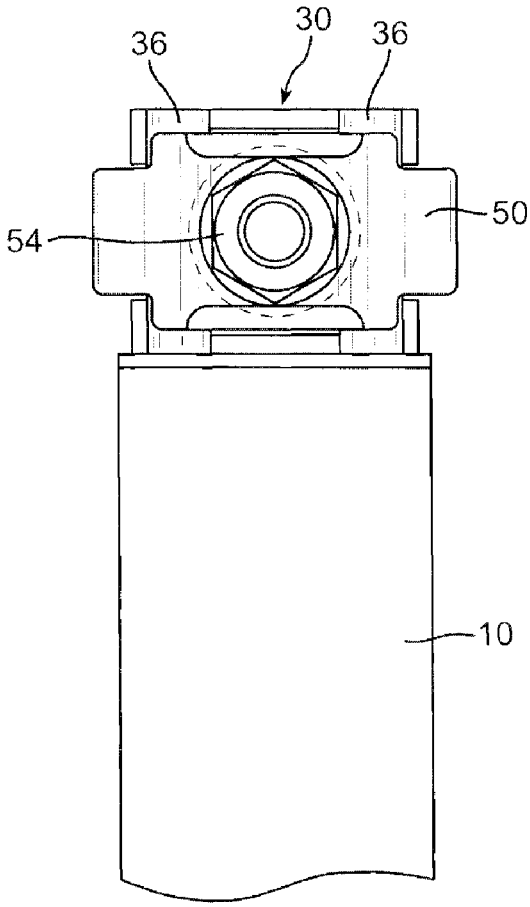
FIG. 5D is a front view of the fuse terminal formed in accordance with the present invention including parallel groove connector components.

FIGS. 5A through 5D illustrate a fuse having a fuse terminal formed in accordance with the present invention used as a parallel groove connector. Similar to the eyebolt connector, only a single component, a parallel groove clamping component 50 and lock washer 52 and nut 54 are needed to attach one or two conductors to the fuse terminal 30. The conductors 56 are placed in the grooves 36 formed in the front face of the fuse terminal 30 and a clamping component 50 having a pair of cooperating grooves is placed over the conductors and bolted in place to secure the conductors directly to the fuse terminal 30. While a single conductor is shown in FIGS. 5A-C, a second conductor can be placed in the second groove formed in the front face of the fuse terminal. Once again, an electrical joint is eliminated when compared to prior art parallel groove connectors. The only electrical joint is provided at the connection point between the conductor and the fuse terminal.

Figure 6A:
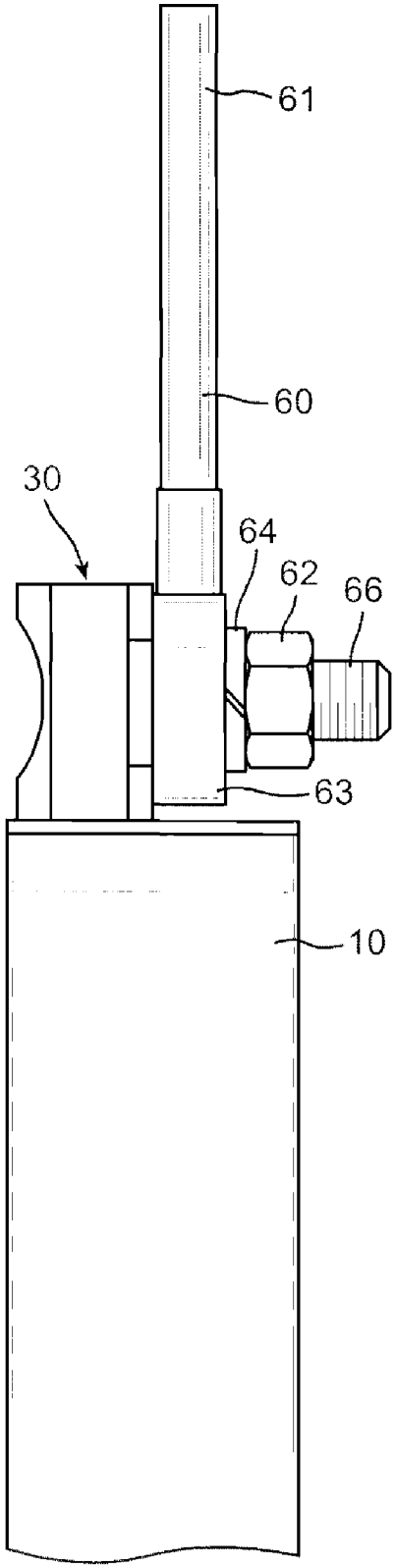
FIG. 6A illustrates a fuse terminal formed in accordance with the present invention used with a universal adaptor.
Figure 6B:
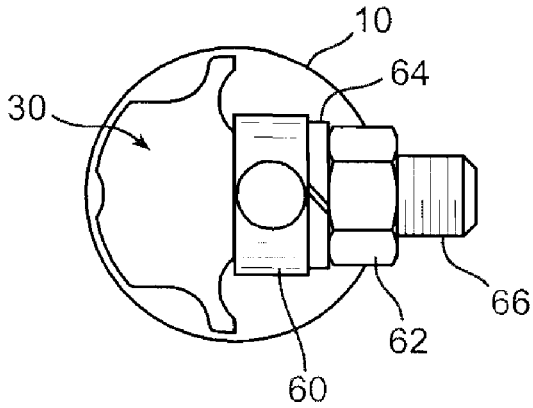
FIG. 6B is a top view of the fuse terminal shown in FIG. 6A.
Figure 6C:
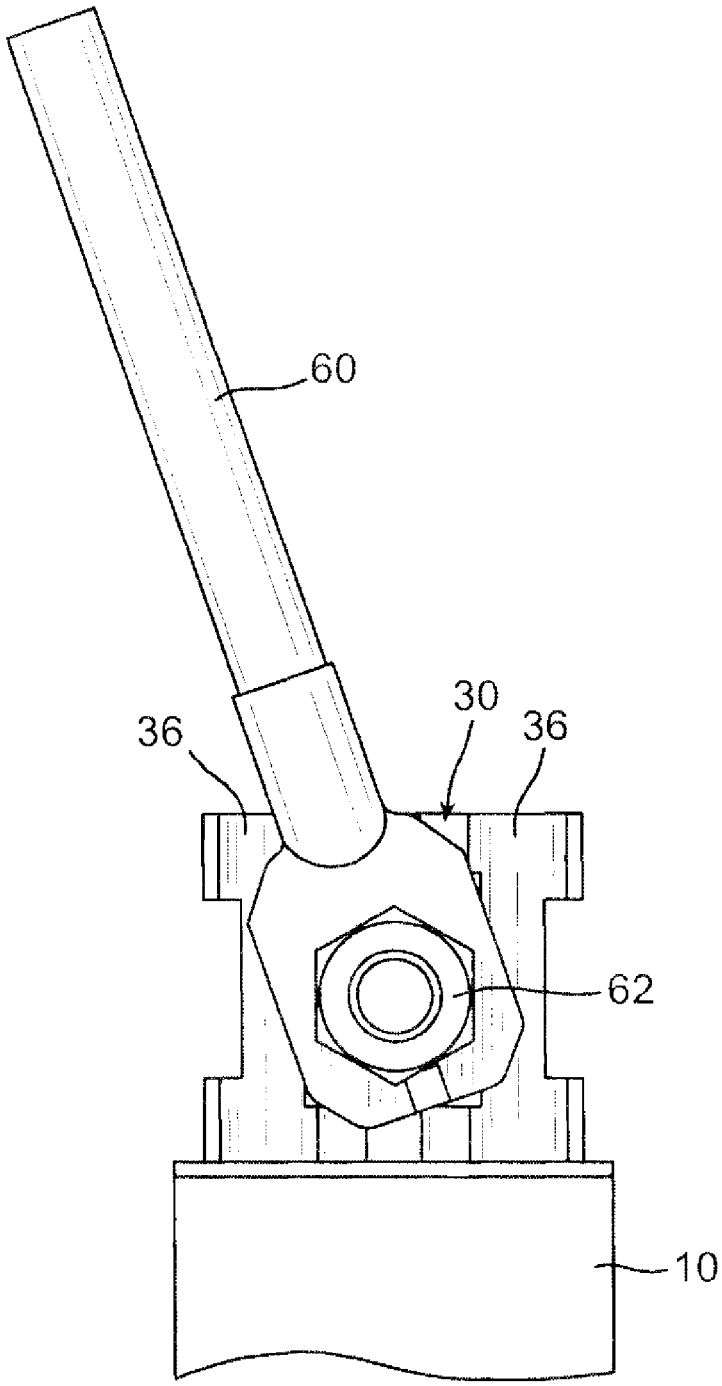
FIG. 6C is a front view of the fuse terminal shown in FIG. 6A.

FIGS. 6A-C illustrate the fuse terminal 30 formed in accordance with the present invention used to mount a universal adaptor 60. The universal adaptor includes an elongated stud portion 61 and a mounting portion 63 for connecting the universal adaptor to the fuse terminal 30. A bolt 66 extends through an aperture in the mounting portion 63 and the aperture in the fuse terminal and lock washer 64 and nut 62 are used to secure the universal adaptor 60 to the fuse terminal. In this case, the fuse terminal 30 provides the versatility of a prior art spade terminal for connecting accessory hardware.

Figure 7A:
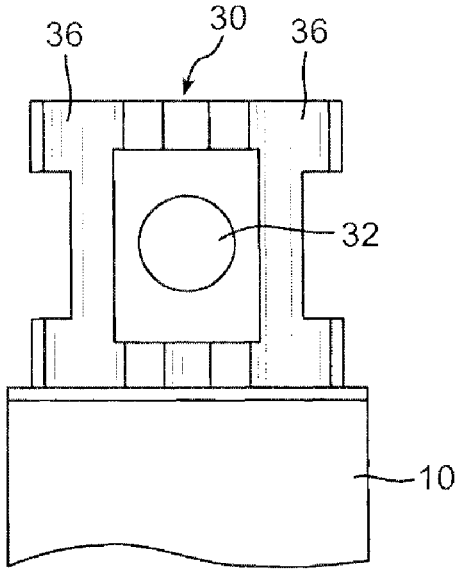
FIG. 7A is a front view of an alternative embodiment of the fuse terminal formed in accordance with the present invention having a single face adapted to receive either an eyebolt connector component or a parallel groove connector component.
Figure 7B:
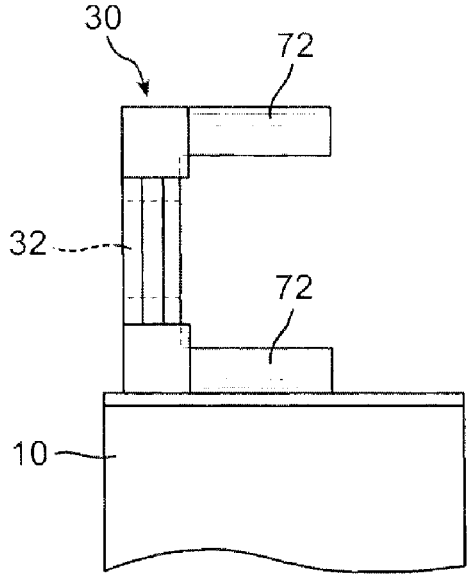
FIG. 7B is a side view of the fuse terminal shown in FIG. 7A.
Figure 7C:
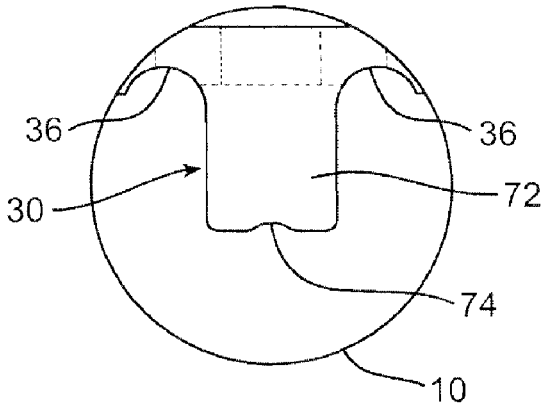
FIG. 7C is a top view of the fuse terminal shown in FIG. 7A.

An alternative embodiment of the present invention includes a fuse terminal wherein a single face thereof is adapted to receive either an eyebolt connector component, a parallel groove connector component or an accessory component such as a universal adaptor. As shown in FIGS. 7A-C, a fuse 10 has a fuse terminal 30 at an end thereof. The fuse terminal 30 includes a face having a pair of spaced apart, parallel grooves 36 adapted to receive a parallel groove connector component. The fuse terminal 30, on the same face, includes a pair of outwardly extending arms 72 having a groove 74 located centrally on an outer extent thereof. The arms 72 extend from a bottom surface and top surface of the fuse terminal, respectively, with a space therebetween. The fuse terminal 30 also includes a centrally located aperture extending from the face including the grooves through the fuse terminal. The groove 74 is adapted to hold a conductor in contact with the fuse terminal in combination with an eyebolt connector component 40 mounted in the aperture of the fuse terminal. The surface opposite that having the structures to accommodate the connector components may take any appropriate shape, preferably one that fits within the periphery of the fuse housing.

It is to be understood that various modifications may be made yet fall within the scope of the invention. For example, the front and rear faces may be switched in positions and various modifications to the locations of the grooves provided in faces may be made. The fuse terminal made in accordance with the present invention achieves the result of single terminal which can accommodate an eyebolt, a parallel groove connector or other accessory component mounted in the aperture provided therein. Furthermore, a component part from the connector assembly is eliminated when used with an eyebolt connector or a parallel groove connector. By eliminating a component from the connector assembly, an electrical joint has been eliminated as well to provide enhanced electrical continuity.

Having illustrated and described preferred embodiments of the invention and certain possible modifications thereto, it should be apparent to those of ordinary skill in the art that the invention may be further modified in arrangement and detail without departing from the scope and spirit of the invention.

What is claimed is:

1. A high voltage fuse comprising:

a fuse housing having a longitudinal axis, a substantially cylindrical shape, two distal ends and a fuse element housed therein; and at least one fuse terminal connected to the fuse element and extending directly from one of the distal ends of the fuse housing and permanently attached thereto, each fuse terminal comprising:

two opposing sides;

a first face on one side of said fuse terminal, the first face having an elongated groove therein, wherein the elongated groove extends substantially parallel to the longitudinal axis;

a second face on the opposite side of said fuse terminal, the second face including at least two elongated grooves therein, wherein the at least two elongated grooves extend substantially parallel to the longitudinal axis, and wherein the grooves are adapted to receive a conductor in direct physical contact therewith; and an aperture extending through the fuse terminal from the first face to the second face.

2. A high voltage fuse as defined in claim 1, wherein the groove in the first face is centrally located thereon.

3. A high voltage fuse as defined in claim 1, wherein the at least two grooves in the second face are spaced apart from one another.

4. A high voltage fuse as defined in claim 3, wherein the two grooves on the second face are substantially parallel to each other.

5. A high voltage fuse as defined in claim 1, further comprising an eyebolt connector component dimensioned to be received in the fuse terminal aperture and means for securing the eyebolt to the fuse terminal, wherein the groove in the first face and the eyebolt cooperate to secure the conductor to the fuse terminal.

6. A high voltage fuse as defined in claim 1, further comprising a parallel groove connector clamping component and means for securing the clamping component to the fuse terminal, wherein the clamping component includes at least two grooves which cooperate with the at least two grooves in the second face of the fuse terminal to secure the conductor or optionally the conductor and a second conductor to the fuse terminal.

7. A method of attaching a conductor to a fuse comprising the steps of:

providing a fuse comprising:

a fuse housing having a substantially cylindrical shape, two ends and a longitudinal axis and comprising a fuse element housed therein; and at least one fuse terminal connected to the fuse element and extending directly from one of the ends of the fuse housing and permanently attached thereto, each fuse terminal including a first face having an elongated groove therein and an aperture extending through the fuse terminal from said first face to a second opposing face, wherein the elongated groove on the first face extends substantially parallel to the longitudinal axis;

providing an eyebolt connector component having an aperture at one end thereof and a threaded portion at an opposite end;

placing the threaded portion of the eyebolt connector component through the fuse terminal aperture;

placing a conductor into the aperture of the eyebolt; and securing the conductor within the eyebolt aperture in direct physical contact with the fuse terminal using a nut tightened on the threaded portion of the eyebolt connector component.

8. A method of attaching up to two conductors to a single fuse terminal comprising the steps of:

providing a high voltage fuse comprising:

a fuse housing having a substantially cylindrical shape, two ends and a longitudinal axis and comprising a fuse element housed therein; and at least one fuse terminal connected to the fuse element and extending directly from one of the ends of the fuse housing and permanently attached thereto, the at least one fuse terminal including a substantially planar face having at least two elongated grooves therein and an aperture extending from said face through the fuse terminal, wherein the elongated groove on the face extends substantially parallel to the longitudinal axis;

providing a parallel groove clamping component having an aperture therethrough and a pair of grooves therein, and means for securing the clamping component to the fuse terminal by a fastener placed through aligned apertures in the fuse terminal and clamping component;

loosely positioning the clamping component over the fuse terminal face including the grooves to align the grooves in the clamping component therewith;

selectively placing the one or two conductors into one or two spaces formed by the grooves in the fuse terminal and the opposing grooves in the clamping component; and securing the one or two conductors in direct physical contact with the fuse terminal with said fastener.

9. A fuse comprising:

a fuse housing having a longitudinal axis, a substantially cylindrical shape, two distal ends and a fuse element housed therein;

at least one fuse terminal directly extending from one of the distal ends of the fuse housing and permanently attached thereto, the fuse terminal including a first face having an aperture extending through the fuse terminal from said first face to a second opposing face, and at least one elongated groove in said first face for receiving one of an eyebolt connector component and a parallel groove clamping component, said at least one groove cooperating with one of the eyebolt connector component and the parallel groove clamping component to cooperatively secure at least one conductor in direct physical contact with the fuse terminal, wherein the elongated groove extends substantially parallel to the longitudinal axis.

10. A fuse as defined in claim 9, wherein the eyebolt connector component includes a threaded portion dimensioned to be received in the fuse terminal aperture and a nut for securing the eyebolt connector component to the fuse terminal.

11. A fuse as defined in claim 10, wherein the second face includes at least two elongated grooves therein adapted to cooperate with the parallel groove clamping component having two corresponding grooves thereon.

12. A fuse as defined in claim 9, wherein the first face includes two grooves substantially parallel to each other and adapted to receive a parallel groove connector component having two corresponding grooves thereon.

* * * * *